United States Patent [19]

Lewis et al.

[11] 3,998,843

[45] * Dec. 21, 1976

[54] QUATERNARY AMMONIUM COMPOUNDS

[75] Inventors: John William Lewis, N. Ferriby; Michael John Readhead, Hull, both of England

[73] Assignee: Reckitt & Colman Products Limited, England

[ * ] Notice: The portion of the term of this patent subsequent to Aug. 12, 1992, has been disclaimed.

[22] Filed: June 4, 1973

[21] Appl. No.: 366,604

[30] Foreign Application Priority Data

June 7, 1972 United Kingdom ..... 26603/72

[52] U.S. Cl. ..... 260/326.41; 260/293.72; 260/293.74; 260/293.81; 260/293.84; 260/326.5 M; 260/326.81; 260/326.87; 260/567.6 M; 260/570.5 CA; 424/267; 424/274; 424/300; 424/301; 424/329

[51] Int. Cl.[2] ..... C07D 207/06; C07D 207/08

[58] Field of Search ..... 260/326.87, 326.41, 260/326.5 M, 293.77, 293.84, 293.72, 293.74, 293.81, 567.6 M, 326.81

[56] References Cited

UNITED STATES PATENTS

| | | | |
|---|---|---|---|
| 3,634,454 | 1/1972 | Lewis et al. | 260/326.5 M |
| 3,652,589 | 3/1972 | Flick et al. | 260/326.5 |
| 3,899,510 | 8/1975 | Lewis et al. | 260/326.5 M |
| 3,960,961 | 6/1976 | Leonicer | 260/570.5 CA |

OTHER PUBLICATIONS

Wagner et al., Synthetic Organic Chemistry (1953) p. 668.

*Primary Examiner*—Raymond V. Rush
*Attorney, Agent, or Firm*—Bacon & Thomas

[57] ABSTRACT

Compounds of the formula:

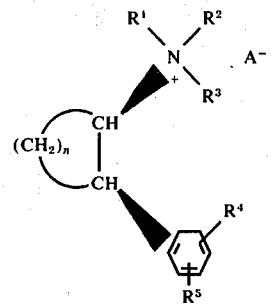

I wherein $n$ is an integer selected from 3, 4 and 5 and $R^1$, $R^2$, $R^3$, $R^4$, $R^5$ and A represent certain specified substituent groups. The compounds are inhibitors of acetylcholinesterase. Particularly preferred compounds are cis-2-(3-hydroxyphenyl)-1-pyrrolidinocyclohexane methobromide and cis-2-(3,6-dihydroxyphenyl)-1-pyrrolidinocyclohexane methiodide.

13 Claims, No Drawings

QUATERNARY AMMONIUM COMPOUNDS

BACKGROUND OF THE INVENTION

This invention relates to novel quaternary ammonium compound, to processes for their perparation and to pharmaceutical formulations containing such compounds. The compounds of the invention are inhibitors of acetylcholinesterase.

PRIOR ART

British Patent Specification No. 758,143 relates to substituted cyclohexylamines having the formula

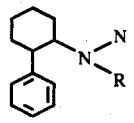

wherein R represents a lower-alkyl or lower-alkanoyl radical having up to 10 carbon atoms and acid addition and quaternary ammonium salts thereof. The compounds are stated to have therapeutic utility as pressor amines, but no other utility is stated for these compounds.

SUMMARY OF THE INVENTION

The present invention provides compounds of the formula:

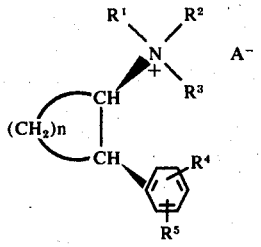

I wherein $n$ is an integer of from 3 to 5 inclusive;

$R^1$ is alkyl of from 1 to 3 carbon atoms inclusive;

$R^4$ is selected from the group consisting of hydrogen, hydroxy, chlorine, alkyl of from 1 to 3 carbon atoms inclusive and the group $OR^6$ where $R^6$ is selected from the group consisting of acetyl, propionyl, butyryl, carbamoyl, methylcarbamoyl, ethylcarbamoyl, propylcarbamoyl, dimethylcarbamoyl, diethylcarbamoyl and dephenylcarbamoyl;

$R^5$ is hydrogen and when $R^4$ is hydroxy $R^5$ may additionally be selected from the group consisting of methyl, chlorine and hydroxy;

$NR^2R^3$ is selected from the group consisting of pyrrolidino and piperidino and when $R^4$ is hydroxy $NR^2R^3$ may additionally be selected from the group dimethylamino and diethylamino; and A is a pharmaceutically acceptable anion.

DESCRIPTION OF THE PREFERRED EMBODIMENTS

In a preferred aspect of the invention there are provided compounds of Formula I in which $n$ is an integer 4, $R^1$ is methyl, $NR^2R^3$ is pyrrolidino, $R^4$ is 3-hydroxy, $R^5$ is hydrogen or 6-hydroxy, A is bromide or iodide.

Particularly preferred compounds are cis-2-(3-hydroxyphenyl)-1-pyrrolidinocyclohexane methobromide and cis-2-(3-dihydroxyphenyl)-1-pyrrolidinocyclohexane methiodide.

Examples of pharmaceutically acceptable anions are chloride, bromide, iodide, methyl sulphate, and p-toluenesulphonate.

The invention also provides therapeutic compositions comprising a compound of Formula I together with a pharmaceutically acceptable diluent or carrier.

It will be appreciated that the compounds have the cis-configuration of the aryl and quaternary ammonium groups.

As mentioned previously the compounds of the invention are potent inhibitors of acetylcholinesterase and may be expected to be of use in clinical situations which are attributable to an effective lack of the neurotransmitter acetylcholine.

The compounds may be prepared by reacting an alkyl halide or sulphate $R^1X$ where $R^1$ is as hereinbefore defined, with a base of the formula:

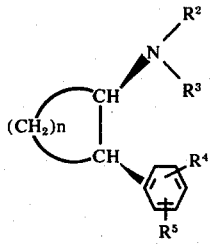

II in which $n$, $R^2$, $R^3$, $R^4$ and $R^5$ are as hereinbefore defined, and if desired, converting the resulting quaternary compound into another quaternary salt by conventional methods.

The invention is further illustrated by the following non-limiting examples:

EXAMPLE 1 cis-2-Phenyl-1-pyrrolidinocyclohexane Methiodide

A solution of cis-2-phenyl-1-pyrrolidinocyclohexane (5.0g) and iodomethane (10g, 3 moles) in diethyl ether (50 ml) was allowed to stand at room temperature for 96 hours. The precipitated solid (5.5g) was collected and crystallised from ethyl acetate/ethanol to give the desired product (4.5g), m.p. 178° to 180° C.

Found: C,55.0; H,7.0; N, 3.9; I, 33.7 $C_{17}H_{26}IN$ requires C,55.0; H,7.1; N,3.8; I,34.2%.

EXAMPLE 2 cis-2-(3-Hydroxyphenyl)-1-pyrrolidinocyclohexane Methobromide a. 2-(3-Methoxyphenyl) cyclohexanone (30g), pyrrolidine (20g) and 98 to 100% formic acid (20g) were heated under reflux at 130° to 140° C for 18 hours. The cooled mixture was poured into dilute hydrochloric acid, washed with ether, basified and ether extracted. The dried extract was evaporated to give cis-2-(3-methoxyphenyl)-1-pyrrolidinocyclohexane (19g) as a colourless oil. A sample distilled at 150° to 154° C/1 mm gave a hydrochloride m.p. 145° to 147° C.

Found: C,68.7; H,8.8; N,4.7; Cl, 12.4 $C_{17}H_{25}NO.HCl$ requires C,69.0; H,8.9; N,4.7; Cl,11.9%.

b. (1) The above oil (19g) was boiled in 47% hydrobromic acid (60 ml) for six hours. The cooled solution was diluted with water, washed with ether, basified and ether extracted. The dried extract was evaporated. The residue was triturated with petroleum ether (b.p. 40° to 60° C) and crystallised from petroleum ether (b.p. 60° to 80° C)/ ethyl acetate to give cis-2-(3-hydroxyphenyl)-1-pyrrolidinocyclohexane (12g), m.p. 124° to 126° C.

Found: C,77.7; H,9.6; N,5.5. $C_{16}H_{23}NO$ requires C,78.2; H,9.5; N, 5.7%.

b. (2) A solution of cis-2-(3-methoxyphenyl)-1-pyrrolidinocyclohexane (2.5g) in dichloromethane was added cautiously to an ice-cold solution of boron tribromide (3 ml) in dichloromethane (15 ml). The mixture was set aside at room temperature for 18 hours and was hydrolysed with water. The aqueous layer was collected, made alkaline with ammonia and extracted with ether. The ether extracts were washed, dried ($Na_2SO_4$) and evaporated. The residue was crystallised from aqueous ethanol to give cis-2-(3-hydroxyphenyl)-1-pyrrolidinocyclohexane (2.0g), m.p. 125° to 127° C, identical to (b)(1) above.

c. A solution of cis-2-(3-hydroxyphenyl)-1-pyrrolidinocyclohexane (0.6g) in ethylmethyl ketone was cooled in an ice/water bath and methyl bromide (1.5 ml) was added. The flask was tightly stoppered and set aside at room temperature for 72 hours. The solid (0.7g) was collected and recrystallised from ethyl acetate/ethanol to give cis-2-(3-hydroxyphenyl)-1-pyrrolidinocyclohexane methobromide (0.4g) m.p. 189° to 192° C.

Found: C,59.8; H,7.6; N,4.1; Br, 23.4 $C_{17}H_{26}BrNO$ requires C,59.9; H,7.7; N,4.1; Br,23.5%

EXAMPLE 3 cis-2-Phenyl-1-pyrrolidinocyclohexane Methochloride

An aqueous solution of cis-2-phenyl-1-pyrrolidinocyclohexane methiodide (0.5g) was stirred at 80° to 100° C with freshly prepared silver chloride (from silver nitrate 0.5g) for 3 hours, cooled and filtered. The filtrate was evaporated and the residue triturated with ethyl acetate to give the methochloride (0.2g) m.p. 193° to 7° C.

Found: C,71.2; H,9.2; N,5.0; Cl, 12.2, $C_{17}H_{26}ClN.\frac{1}{2}H_2O$ requires C,70.7; H,9.4; N,4.9; Cl, 12.3%.

EXAMPLE 4 cis-2-(3-Hydroxyphenyl)-1-pyrrolidinocyclohexane methochloride

An aqueous solution of cis-2-(3-hydroxyphenyl)-1-pyrrolidinocyclohexane methiodide (1.0g) was stirred at 80° to 100° C with freshly prepared silver chloride (from silver nitrate 1.0g) for 3 hours, cooled and filtered. The filtrate was evaporated and the residue triturated with ethyl acetate to give the methochloride (0.5g) m.p. 135° to 140° C.

Found: C,65.8; H,8.8; N,4.3; Cl,11.1, $C_{17}H_{26}Cl$ $NO.H_2O$ requires C,65.1; H,9.0; N,4.5; Cl,11.3%.

EXAMPLE 5 cis-2-(3-Butyryloxyphenyl)-1-pyrrolidinocyclohexane methiodide

Butyryl chloride (4g) was added cautiously at room temperature to a solution of cis-2-(3-hydroxyphenyl)-1-pyrrolidinocyclohexane (5g) and triethylamine (10 ml) in dichloromethane. After 48 hours at room temperature the mixture was washed with water, the organic layer was collected, dried ($Na_2SO_4$) and evaporated. The residue was chromatographed on an alumina column (neutral; grade 1) eluting with ethyl acetate/petroleum ether (b.p. 60° to 80° C)(1:4), evaporation of the solvent gave an oil (5.5g). The oil (5.0g) was dissolved in ether and iodomethane (10g) added; the mixture was set aside at room temperature for 48 hours. The solid was collected and recrystallised from ethyl acetate/ethanol to give the methiodide (3.8g) m.p. 166° to 167° C Found: C,55.1; H,6.8; N,2.9; I,27.9, $C_{21}H_{32}INO_2$ requires C,55.1; H,7.1; N,3.1; I,27.8%.

EXAMPLE 6 cis-2-(3-Dimethylcarbamoyloxyphenyl)-1-pyrrolidinocyclohexane methiodide cis-2-(3-Hydroxyphenyl)-1-pyrrolidinocyclohexane (6g), triethylamine (10g) and dimethylcarbamoyl chloride (5.3g) were heated in boiling xylene under reflux for 5 hours. The cooled mixture was poured into water and extracted into ether. The ether extracts were washed, dried ($Na_2SO_4$) and evaporated. The residue (7.9g) was chromatographed on an alumina column (400g; neutral, grade 1) eluting with ethyl acetate/petroleum ether (b.p. 60° to 80° C)(1:9), evaporation of the solvent afforded an oil (5.0g). The oil (5.0g) was dissolved in ether and iodomethane (7g) added; the mixture was set aside at room temperature for 24 hours. The solid was collected and recrystallised from ethyl acetate/ethanol to give the methiodide (4.2g) m.p. 184° to 186° C Found: C, 52.4; H,6.9; N, 6.2; I, 28.1. $C_{20}H_{31}IN_2O_2$ requires C, 52.4; H,6.8; N,6.1; I,27.7%.

Table

| Example | $R^2$ | $R^3$ | A | $R^4$ | n | Yield % | m.p. °C | % Found C | % Found H | % Found N | Formula | % Calculated C | % Calculated H | % Calculated N |
|---|---|---|---|---|---|---|---|---|---|---|---|---|---|---|
| 7 | $-(CH_2)_4-$ | | I | 4-Me | 4 | 40 | 124–127 | 56.0 | 7.4 | 3.6 | $C_{18}H_{28}IN$ | 56.2 | 7.3 | 3.6 |
| 8 | $-(CH_2)_4-$ | | I | 3-Me | 4 | 50 | 176–178 | 55.7 | 7.2 | 3.7 | $C_{18}H_{28}IN$ | 56.2 | 7.3 | 3.6 |
| 9 | $-(CH_2)_4-$ | | I | 3-Cl | 4 | 45 | 160–162 | 49.8 | 6.2 | 3.2 | $C_{17}H_{25}ClIN$ | 50.3 | 6.2 | 3.5 |
| 10 | $-(CH_2)_4-$ | | I | 4-Cl | 4 | 50 | 187–189 | 50.3 | 6.0 | 3.3 | $C_{17}H_{25}ClIN$ | 50.3 | 6.2 | 3.5 |
| 11 | $-(CH_2)_4-$ | | I | 3-OH | 4 | 75 | 160–164 | 52.5 | 6.8 | 3.6 | $C_{17}H_{26}INO$ | 52.7 | 6.8 | 3.6 |
| 12 | $-(CH_2)_4-$ | | I | 4-OH | 4 | 70 | 232–233 | 52.7 | 6.8 | 4.0 | $C_{17}H_{26}INO$ | 52.7 | 6.8 | 3.6 |
| 13 | $-(CH_2)_5-$ | | I | H | 4 | 55 | 212–214 | 56.1 | 7.4 | 3.6 | $C_{18}H_{28}IN$ | 56.1 | 7.3 | 3.6 |
| 14 | $-(CH_2)_4-$ | | I | 3-OH | 3 | 90 | 125–127 | 51.3 | 6.5 | 3.8 | $C_{16}H_{24}INO$ | 51.5 | 6.5 | 3.8 |
| 15 | $-(CH_2)_4-$ | | I | 3-OCOMe | 4 | 50 | 152–154 | 53.0 | 6.4 | 3.2 | $C_{19}H_{28}INO_2$ | 53.1 | 6.6 | 3.3 |
| 16 | $-(CH_2)_4-$ | | I | 3-OH | 4 | 50 | 195–197 | 50.7 | 6.5 | 3.7 | $C_{17}H_{26}INO_2$ | 50.6 | 6.5 | 3.5 |
| 17 | $-(CH_2)_4-$ | | I | 3-OH | 5 | 30 | 180–185 | 53.7 | 7.2 | 3.2 | $C_{18}H_{28}INO$ | 53.9 | 7.0 | 3.5 |
| 18 | Me | Me | I | 3-OH | 4 | 50 | 136–141 | 51.4 | 6.9 | 3.8 | $C_{16}H_{26}INO$ | 51.2 | 7.0 | 3.8 |
| 19 | $-(CH_2)_4-$ | | I | 3-OCONPh$_2$ | 4 | 65 | 208–211 | 61.9 | 6.1 | 4.7 | $C_{30}H_{35}IN_2O_2$ | 61.9 | 6.1 | 4.8 |
| 20 | $-(CH_2)_4-$ | | I | 3-OCONEt$_2$ | 4 | 55 | 198–201 | 53.8 | 7.1 | 5.7 | $C_{22}H_{35}IN_2O_2$ | 54.2 | 7.2 | 5.8 |

The table sets out details of further examples of compounds of Formula I in which $R^1$ is methyl and $R^5$ is hydrogen, except in Example 16 where R is 6-hydroxy and Example 18 where R is ethyl. Examples 7 to 18 were prepared by the method of Example 1, and Examples 19 and 20 by the method of Example 6.

EXAMPLE 21

N-(cis-2-Phenylcyclohexyl)-N-methylpyrrolidinium p-toluensulphonate cis-2Phenyl-1-pyrrolidinocyclohexane (2.3g) and methyl-p-toluenesulphonate (1.9g) were heated in boiling ethyl acetate under reflux for 18 hours. An oil slowly formed which quickly crystallised on cooling. Recrystallisation from ethyl alcohol/ethyl acetate afforded the quaternary salt (3.0g), m.p. 146° to 148° C Analysis Found: C, 68.0; H, 8.3; N, 3.2; S, 7.6. $C_{24}H_{33}NO_3S\frac{1}{2}H_2O$ requires C, 67.8; H, 8.1; N, 3.3; S, 7.5%.

Screening for anticholinesterase activity was carried out in vitro by the Michel method (J. Lab. Clin. Med 34, 1564, (1949)) using acetylcholine as substrate, washed human red cells as the source of acetylcholinesterase. Concentrations of drugs giving approximately 50% inhibition of acetylcholinesterase are set out in the Table:

| No. of Example | Concentration |
|---|---|
| 1 | $2 \times 10^{-7}$M |
| 2 | $2 \times 10^{-8}$M |
| 5 | $2 \times 10^{-8}$M |
| 7 | $10^{-6}$M |
| 8 | $6 \times 10^{-6}$M |
| 10 | $2 \times 10^{-7}$M |
| 11 | $2 \times 10^{-8}$M |
| 14 | $10^{-7}$M |
| 16 | $10^{-8}$M |
| Edrophonium | $5 \times 10^{-5}$M |
| Neostigmine | $4 \times 10^{-7}$M |

The figures for Edrophonium and Neostigmine are given for comparison purposes. The figures show that the compounds possess anticholinesterase properties comparable to or in some cases more potent than neostigmine, a clinically established drug. In contrast to the above results the corresponding concentration for trans-2-(3-hydroxyphenyl)-1-pyrrolidinocyclohexane methiodide (the trans compound corresponding to the cis-compound Example 11) was only $10^{-4}$M i.e. the cis compound is some 5000 × as active as the trans compound.

Compounds that are potent inhibitors of acetyl cholinesterase may be expected to be of use in clinical situations where the pathological conditions are characterised by a lack of either skeletal or smooth muscle tone e.g. myasthenia gravis, paralytic ileus, urinary retention and glaucoma. They may also be used in the reversal of muscle relaxation induced during surgery by non-depolarising skeletal muscle relaxants such as D-tubocurarine.

D-Tubocurarine is used clinically to produce relaxation of skeletal muscles in patients undergoing certain surgical procedures. Following the completion of surgery antiacetylcholinesterases are used to reverse this relaxation. Experiments have been carried out to measure the ability of the compounds of the invention to reverse tubocurarine-induced muscle blockade in rats and cats.

The method was based on that of Zaimis E, J. Physiol 122, 238 (1953) in which animals were anaesthetised and the left hind limb clamped ridigly in a horizontal position with the tendon of the anterior tibialis muscle attached to a flat spring myograph. Twitches of the anterior tibialis muscle were induced by supramaximal electrical stimulation of the tibial nerve and recorded on a strip recorder. Drugs dissolved in 0.9% saline were injected into the femoral vein. During an experiment the dose of tubocurarine necessary to establish a partial (80 to 90%) blockade of neuromuscular transmission was established an anticholinisterase drugs were subsequently injected at the time of maximum blockade. Recovery achieved after the administration of an antiacetylcholinesterase was compared with the recovery after tubocurarine alone. The results for the compounds of examples 1 and 11 are given below together with results for neostigmine, a drug employed in current clinical practice.

| No. of Example | Dose (μg/kg) necessary to produce maximum anticurare effect | |
|---|---|---|
| | Cat | Rat |
| 1 | 100 | 100 |
| 11 | 30 | 25 |
| Neostigmine | 100 | 100 |

The intravenous LD50 has been determined in rats for the three above mentioned drugs and from the results obtained the therapeutic ratios (defined as the ratio of LD50 to the dose giving maximum tubocurarine reversal) have been calculated:

| No. of Example | LD50 mg/kg | Therapeutic ratio |
|---|---|---|
| 1 | 1.5 | 7.2 |
| 11 | 0.18 | 15 |
| Neostigmine | 0.2 | 2 |

These results suggest that the compounds of Examples 1 and 11 would be expected to have a wide margin of safety when used in man.

In the clinic a dose of 2.5–3.0 mg neostigmine is administered intravenously to reverse the neuromuscular effects of tubocurarine. On the basis of the above results it is expected that the likely effective intravenous dose in man of cis-2-phenyl-1-pyrrolidinocyclohexane methobromide would be 1.0 to 3.0 mg whilst that for cis-2-(3-hydroxyphenyl)-1-pyrrolidinocyclohexane methobromide 0.5 to 1.0 mg. A disadvantage of employing neostigmine in man is the necessity of prior dosing with atropine (1 mg) to prevent undesired muscarinic effects (e.g. salivation, increased gut motility). Animal experimentation with the compounds of Examples 1 and 11 has shown that the compounds possess less muscarinic activity and consequently it may not be necessary to predose a patient with atropine.

Substantiation for some of these estimates has come from the results of tests carried out in human volunteers. In these experiments contractions of the anterior compartment leg muscles were induced by supramaximal stimulation of the lateral popliteal nerve. After recording a period of control activity, tubocurarine was administered as a slow I.V. infusion until the muscle twitch height was reduced to approximately 50% of control levels. Three minutes later the anticholinesterase was administered (I.V. in saline) and the twitch height monitored until control levels were re-attained. Recovery produced by 2.5 mg neostigmine (proceeded by 1.2 mg atropine) was compared with the recovery produced by cis-2-(3hydroxyphenyl)-1-pyrrolidinocyclohexane methobromide (0.6 to 0.8 mg). Prompt recovery was induced in both cases but the incidence of muscarinic effects produced by the latter compound was less than that produced by the neostigmine/atropine combination.

Myasthenia is a syndrome of increased fatiquability in striated muscle. The characteristic feature from which the disease derives its name is a severe weakness of voluntary muscles which begins after exercise but which may disappear after a short rest. Although the weakness may affect any muscle, the eyelids, extraocular muscles, bulbar muscles, neck and proximal muscles of the upper limbs are most commonly involved. The hand, lower limb and trunk muscles are usually involved later. It is now accepted that acetylcholine is the neurotransmitter at the neuromuscular junction. In myasthenia there appears to be a disturbance in the release of acetylcholine from the nerve ending resulting in impaired neuromuscular transmission. The symptoms which appear as a result of this defect may be treated by blocking acetylcholinesterase, the enzyme normally responsible for the metabolism of acetylcholine.

There is no accepted animal model for myasthenia gravis at present and prospective drugs are initially assessed for their antiacetylcholinesterase activity rather than antimyasthenic activity. Anitacetylcholinesterase tests may be subdivided into in vitro and in vivo tests.

In vitro testing of compounds was carried out by the method of Ellmann, Biochem. Pharmacol. 7, 88 (1961) with acetylthiocholine as substrate and bovine erythrocyte acetylcholinesterase as enzyme. Reaction rates were determined with and without inhibitor under competitive conditions (i.e. the substrate was added before the inhibitor). Results were plotted by the Lineweaver-Burk method and these plots were used to determine inhibitor constants (Ki values). The following are the results for the compounds of Examples 1 and 11 together with the comparative result for neostigmine.

| No. of Example | Ki |
|---|---|
| 1 | $7.7 \times 10^{-9}$M |
| 11 | $7.3 \times 10^{-9}$M |
| Neostigmine | $3.0 \times 10^{-8}$M |
| Pyridostigmine | $4.8 \times 10^{-6}$M |

A small Ki value represents high antiacetylcholinesterase activity and from the results it can be seen that the compounds of Examples 1 and 11 are more potent than neostigmine.

In vivo testing was carried out employing the mouse miosis test of Schneider R, J. Pharm. Pharmacol. 22, 298 (1970) in which antiacetylcholinesterases induce constriction of the pupil in the eye of the mouse, and the rat chromodacryorrhoea test of Burgen A.S.V.-Brit.J.Pharmacol. 4; 185 (1949) in which antiacetylcholinesterases potentiate the ability of acetylcholine to provoke red tears in rats. Both tests enable the potency and duration of action of antiacetylcholinesterases to be assessed. The results are set out in a Table which compares the potency of various drugs with that of neostigmine, a current drug of clinical choice.

| No. of Example | Potency Mouse Miosis SC | Rat chromod. IP |
|---|---|---|
| 1 | 1.6 | 2.0 |
| 11 | 9.6 | 6.0 |
| Neostigmine | 1.0 | 1.0 |
| Edrophonium | 0.04 | 0.09 |
| Ambenonium | 0.06 | 0.03 |
| Tacrine | 0.21 | 0.38 |

From these results it can be seen that the compounds of Examples 1 and 11 are more potent than neostigmine and thus in the treatment of myasthenia the likely effective oral dose in man of cis-2-phenyl-1-pyrrolidinocyclohexane methobromide would be 5.0 to 20.0 mg whilst that for cis-2-(3-hydroxyphenyl)-1-pyrrolidinocyclohexane methobromide would be 1.0 to 5.0 mg. The relatively slow reversal of enzyme inhibition achieved after dosage with neostigmine or pyridostigmine is thought by some workers to account for the sudden onset of weakness in myasthenic patients after a period of successful treatment. The weakness is thought to result from excessive depolarisation of the muscle end plate. These two novel compounds are more comparable in action with edrophonium (i.e. they are unable to form co-valent bands with the enzyme) and are thus unable to provoke similar relapses on prolonged treatment. This freedom from relapse should offer advantage to these two compounds.

The pharmaceutical compositions may be in a form suitable for oral adminstration (as in the treatment of myasthenia) or in a form suitable for parenteral administration (as used to reverse the neuromuscular effects of tubocurarine). Such oral compositions may take the form of capsules, tablets, granules or liquid preparations such as elixirs, syrups or suspensions.

Compositions intended for parenteral administration may be in the form of sterile injectable preparations such as solutions in water or saline.

For the purposes of convenience of accuracy of dosing the compositions are advantageously employed in a unit dosage form. For oral administration the unit dosage form contains from 1 mg to 20 mg of the compound of said formula. Parenteral unit dosage forms contain from 0.5 mg to 5.0 mg of the said formula per 1 ml of the preparation.

We claim:

1. A compound of the formula

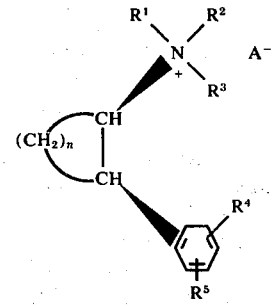

I wherein $n$ is an integer of from 3 to 5 inclusive; $R^1$ is alkyl of from 1 to 3 carbon atoms inclusive; $R^4$ is selected from the group consisting of hydrogen, and at the 3 position hydroxy, chlorine, and the group $OR^6$ where $R^6$ is selected from the group consisting of acetyl, propionyl, butyryl, dimethylcarbamoyl, diethylcarbamoyl and diphenylcarbamoyl; $R^5$ is hydrogen or when $R^4$ is hydroxy $R^5$ may additionally be hydroxy at the 6 position; $NR^2R^3$ is selected from the group consisting of pyrrolidino and when $R^4$ is hydroxy, $NR^2R^2$ may additionally be dimethylamino or diethylamino; and A is a pharmaceutically acceptable anion.

2. A compound of the formula:

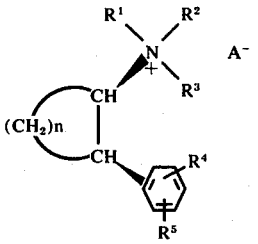

I wherein *n* is an integer of from 3 to 5 inclusive; $R^1$ is alkyl of from 1 to 3 carbon atoms inclusive; $R^4$ is selected from the group consisting of hydrogen, and at the 3 position hydroxy, chlorine, and the group $OR^6$ where $R^6$ is selected from the group consisting of acetyl, propionyl, butyryl, and dimethylcarbamoyl; $R^5$ is hydrogen or when $R^4$ is hydroxy $R^5$ may additionally be hydroxy at the 6 position; $NR^2R^3$ is selected from the group consisting of pyrrolidino and when $R^4$ is hydroxy $NR^2R^3$ may additionally be dimethylamino or diethylamino; and A is a pharmaceutically acceptable anion.

3. A compound of Formula I as claimed in claim 2 wherein n is the integer 4, $R^1$ is methyl, $NR^2R^3$ is pyrrolidino, $R^4$ is hydroxy at the 3-position, $R^5$ is selected from the group consisting of hydrogen and hydroxy at the 6-position and A is an anion selected from the group consisting of bromide or iodide.

4. A compound of Formula I as claimed in claim 2 wherein the anion A is selected from the group consisting of chloride, bromide, iodide, methylsulphate and p-toluenesulphonate.

5. cis-2-Phenyl-1-pyrrolidinocyclohexane methiodide.

6. cis-2-(3-Hydroxyphenyl)-1-pyrrolidinocyclohexane methobromide.

7. cis-2-(Phenyl-1-pyrrolidinocyclohexane)methochloride.

8. cis-2-(3-Hydroxphenyl)-1-pyrrolidinocyclohexane methochloride.

9. cis-2-(3-Butyryloxyphenyl)-1-pyrrolidinocyclohexane methiodide.

10. cis-2-(3-Dimethylcarbamoyloxyphenyl)-1-pyrrolidinocyclohexane methiodide.

11. cis-2-(3-Hydroxyphenyl)-1-pyrrolidinocyclohexane methiodide.

12. N-(cis-2-Phenylcyclohexyl)-N-methylpyrrolidinium p-toluene sulphonate.

13. cis-2-(3,6-Dihydroxyphenyl)-1-pyrrolidinocyclohexane methiodide.

* * * * *